US005971215A

United States Patent [19]

Bartsch

[11] Patent Number: 5,971,215

[45] Date of Patent: Oct. 26, 1999

[54] DISPENSING PUMP LOCK

[75] Inventor: Eric R. Bartsch, Cincinnati, Ohio

[73] Assignee: The Procter & Gamble Company, Cincinnati, Ohio

[21] Appl. No.: 08/709,348

[22] Filed: Sep. 6, 1996

[51] Int. Cl.[6] ..... B67D 5/32

[52] U.S. Cl. ..... 222/153.13; 222/321.7

[58] Field of Search ..... 222/153.01, 153.13, 222/153.14, 321.1, 321.7, 321.9

[56] References Cited

U.S. PATENT DOCUMENTS

| | | | |
|---|---|---|---|
| 2,731,166 | 1/1956 | Raphael | 215/52 |
| 2,947,431 | 8/1960 | Haynes | 215/9 |
| 2,994,447 | 8/1961 | Haynes | 215/9 |
| 3,033,406 | 5/1962 | Sauber | 215/9 |
| 3,059,801 | 10/1962 | Dragon | 215/98 |
| 3,311,247 | 3/1967 | Rigor | 215/9 |
| 3,313,441 | 4/1967 | Fadden | 215/76 |
| 3,383,885 | 5/1968 | Epstein | 70/167 |
| 3,405,828 | 10/1968 | Pierre | 215/9 |
| 3,407,954 | 10/1968 | Millis | 215/9 |
| 3,445,021 | 5/1969 | Johnson | 215/9 |
| 3,587,896 | 6/1971 | Graff | 215/9 |
| 3,684,117 | 8/1972 | Leopoldi et al. | 215/9 |
| 3,978,699 | 9/1976 | Kay 'Triniak | 70/232 |
| 4,011,829 | 3/1977 | Wachsmann et al. | 116/121 |
| 4,011,970 | 3/1977 | Crowle et al. | 222/321 |
| 4,162,746 | 7/1979 | Anderson et al. | 222/153 |
| 4,345,691 | 8/1982 | Burke | 215/216 |
| 4,420,096 | 12/1983 | Kirk, Jr. | 222/44 |
| 4,434,915 | 3/1984 | Kirk, Jr. | 222/153 |
| 4,496,082 | 1/1985 | Corsette | 222/153 |
| 4,589,574 | 5/1986 | Foster | 222/153.13 |
| 4,735,346 | 4/1988 | Stoody | 222/153 |
| 4,867,347 | 9/1989 | Wass et al. | 222/153 |
| 4,991,746 | 2/1991 | Schultz | 222/321 |
| 5,050,779 | 9/1991 | Knickerbocker | 222/153 |
| 5,161,716 | 11/1992 | Knickerbocker | 222/153 |
| 5,358,129 | 10/1994 | Watts | 215/206 |
| 5,366,118 | 11/1994 | Ciammitti et al. | 222/153 |
| 5,405,057 | 4/1995 | Moore | 222/153.13 |
| 5,458,263 | 10/1995 | Ciammitti et al. | 222/153.1 |
| 5,520,305 | 5/1996 | Pierson | 222/153.13 |
| 5,615,806 | 4/1997 | Grothoff | 222/153.13 |

*Primary Examiner*—Joseph A. Kaufman
*Attorney, Agent, or Firm*—William Scott Andes

[57] ABSTRACT

Disclosed is a locking assembly for use with a pump type dispenser to dispense material from a container. The assembly includes an actuator including at least one timing pin and a locking mechanism coupled to the actuator for limiting movement of the actuator until the timing pin is properly aligned with the locking mechanism. Alignment is achieved by rotating the actuator a first predetermined distance in a first direction and subsequently rotating the actuator a second predetermined distance in a second direction.

15 Claims, 6 Drawing Sheets

DISPENSING PUMP LOCK

BACKGROUND OF THE INVENTION

1. Field of the Invention

The invention relates to child resistant locks for product containers. More particularly, the invention relates to child resistant locks designed for use with pump type dispensers.

2. Description of the Prior Art

Pump dispensers are conveniently used by consumers to draw fluid materials from within containers. These dispensers apply pressure to draw the material from within the container and force the material out of an outlet nozzle for use by the consumer. The controlled pumping mechanisms provided by these pump dispensers permits consumers to dispense fluids, and other materials, in a convenient, controlled manner.

Unfortunately, however, these pump type dispensers are often used to dispense materials that are harmful to human beings, animals, and surrounding structures. As such, it is desirable to provide these pump type dispensers with locking assemblies to prevent unwanted pumping of the pump dispenser, particularly, to prevent unwanted pumping by children. The structures of these pump type dispensers make it difficult to incorporate effective locking assemblies capable of preventing a child from actuating the pump dispenser, while readily permitting an adult to pump material from the dispenser after the locking assembly has been disabled.

After reviewing prior pump dispensers, it is apparent that a need exists for a pump dispenser which incorporates a locking assembly to effectively prevent unwanted pumping of material therefrom, while permitting a user to conveniently disable the locking assembly to permit pumping of materials from the pump dispenser. The present invention provides a convenient, reliable and inexpensive child resistant locking assembly for use with pump dispensers, which overcomes the limitations of prior pump dispensers. Additionally, because the present locking assembly relies on coordination rather than force to be opened, it is ideal for use by elderly or arthritic persons.

SUMMARY OF THE INVENTION

It is, therefore, an object of the present invention to provide a child resistant locking assembly for use with a pump type dispenser to prevent unwanted dispensing of material from a container. The assembly includes an actuator including a timing pin and a locking mechanism coupled to the actuator for limiting movement of the actuator until the timing pin is properly aligned with the locking mechanism. Alignment is achieved by rotating the actuator a first predetermined distance in a first direction and subsequently rotating the actuator a second predetermined distance in a second direction, opposite the first direction.

It is a further object of the present invention to provide a locking assembly including an actuator having a downwardly extending timing pin. The assembly also includes a first disk having at least one hole, wherein the timing pin passes through the at least one hole such that the first disk rotates with the actuator, a second disk secured to a support surface of the container, wherein the second disk includes a hole through which the timing pin passes when the hole in the second disk is aligned with the hole in the first disk, and a third disk positioned between the first disk and the second disk, wherein the third disk includes a hole through which the timing pin passes when the hole in the third disk is aligned with the hole in the first disk. The assembly further includes a locking structure associated with the first disk, the second disk, and the third disk. The locking structure permits the actuator to rotate in a first direction to align the hole in the second disk with the hole in the third disk and to rotate in a second direction, opposite the first direction, to align the hole in the first disk with the hole in the third disk. When the hole in the first disk, the hole in the second disk, and the hole in the third disk are not aligned, the timing pin is prevented from passing through the holes and the actuator is prevented from moving up and down to dispense product from the container. In contrast, when the hole in the first disk, the hole in the second disk, and the hole in the third disk are aligned, the timing pin passes through the holes permitting the actuator to move up and down, and dispense material from the container.

It is also an object of the present invention to provide a pump dispenser having a locking assembly. The pump dispenser includes an actuator for drawing materials from a container to dispense the materials from the container, and the actuator includes a downwardly extending timing pin. The pump dispenser also includes an upper rotating disk having at least one hole, wherein the timing pin passes through the at least one hole such that the upper rotating disk rotates with the actuator, a lower fixed disk secured to a support surface of the container, wherein the lower fixed disk includes at least one hole through which the timing pin passes when the hole in the lower fixed disk is aligned with the hole in the upper rotating disk, and a central floating disk positioned between the upper rotating disk and the lower fixed disk, wherein the central floating disk includes at least one hole through which the timing pin passes when the hole in the central floating disk is aligned with the hole in the upper rotating disk. The dispensing pump also includes a locking structure associated with the upper rotating disk, the central floating disk, and the lower fixed disk. The locking structure permits the actuator to rotate in a first direction to align the hole in the central floating disk with the hole in the lower fixed disk and to rotate in a second direction, opposite the first direction, to align the hole in the upper rotating disk with the hole in the central floating disk. When the hole in the upper rotating disk, the hole in the central floating disk, and the hole in the lower fixed disk are not aligned, the timing pin is prevented from passing through the holes and the actuator is prevented from moving up and down to dispense product from the container. However, when the hole in the upper rotating disk, the hole in the central floating disk, and the hole in the lower fixed disk are aligned, the timing pin will pass through the openings and permit the actuator to move up and down to dispense material from the container.

It is a further object of the present invention to provide a container having a body for storing materials therein, wherein the body has a pump dispenser, as discussed above, secured thereto.

It is also an object of the present invention to provide a pump dispenser wherein the locking structure includes a series of ratchet teeth secured to the upper rotating disk, the lower fixed disk, and the central floating disk.

It is another object of the present invention to provide a pump dispenser wherein the locking structure includes a ratchet tooth on a lower surface of the upper rotating disk. The ratchet tooth on the upper rotating disk is positioned to engage a ratchet tooth on an upper surface of the central floating disk such that the ratchet tooth on the upper rotating disk engages the ratchet tooth on the central floating disk to cause the first disk and the central floating disk to rotate together when the actuator is rotated in a first direction. The central floating disk includes a ratchet tooth on a lower surface of the central floating disk, wherein the ratchet tooth on the lower surface of the central floating disk is positioned to engage a ratchet tooth on an upper surface of the lower fixed disk such that the central floating disk may rotate in the first direction relative to the lower fixed disk, but is prevented from rotating in a second direction, opposite the first direction, when the hole in the central floating disk is aligned with the hole in the second floating disk.

It is a further object of the present invention to provide a pump dispenser wherein the locking structure includes at least two ratchet teeth on a lower surface of the upper rotating disk. The at least two ratchet teeth on the upper rotating disk are positioned to respectively engage at least two ratchet teeth on an upper surface of the central floating disk such that the at least two ratchet teeth on the upper rotating disk respectively engage the at least two ratchet teeth on the central floating disk to cause the upper rotating disk and the central floating disk to rotate together when the actuator is rotated in a first direction. The central floating disk also includes at least two ratchet teeth on a lower surface of the central floating disk, wherein the at least two ratchet teeth on the lower surface of the central floating disk are positioned to engage at least two ratchet teeth on an upper surface of the lower fixed disk such that the central floating disk may rotate in the first direction relative to the lower fixed disk, but is prevented from rotating in a second direction, opposite the first direction, when the hole the central floating disk is aligned with the hole in the second floating disk.

It is also an object of the present invention to provide a pump dispenser wherein the actuator includes at least one indicator for indicating when the holes in the upper rotating disk, the central floating disk and the lower fixed disk are aligned.

It is also an object of the present invention to provide a pump dispenser wherein the actuator includes a first indicator indicating when the hole in the lower fixed disk is aligned with the hole in the central floating disk, and a second indicator indicating when the hole in the upper rotating disk is aligned with the hole in the central floating disk.

It is another object of the present invention to provide a pump dispenser wherein the actuator includes a first downwardly extending timing pin and a second downwardly extending timing pin, the upper rotating disk includes a first hole and a second hole, the central floating disk includes a first hole and a second hole, and the lower fixed disk includes a first hole and a second hole. The first holes and the second holes of the disks being positioned such that they may be aligned to permit the first timing pin and the second timing pin to simultaneously pass through the respective first holes and second holes, thereby permitting the actuator to function to dispense material from the container.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
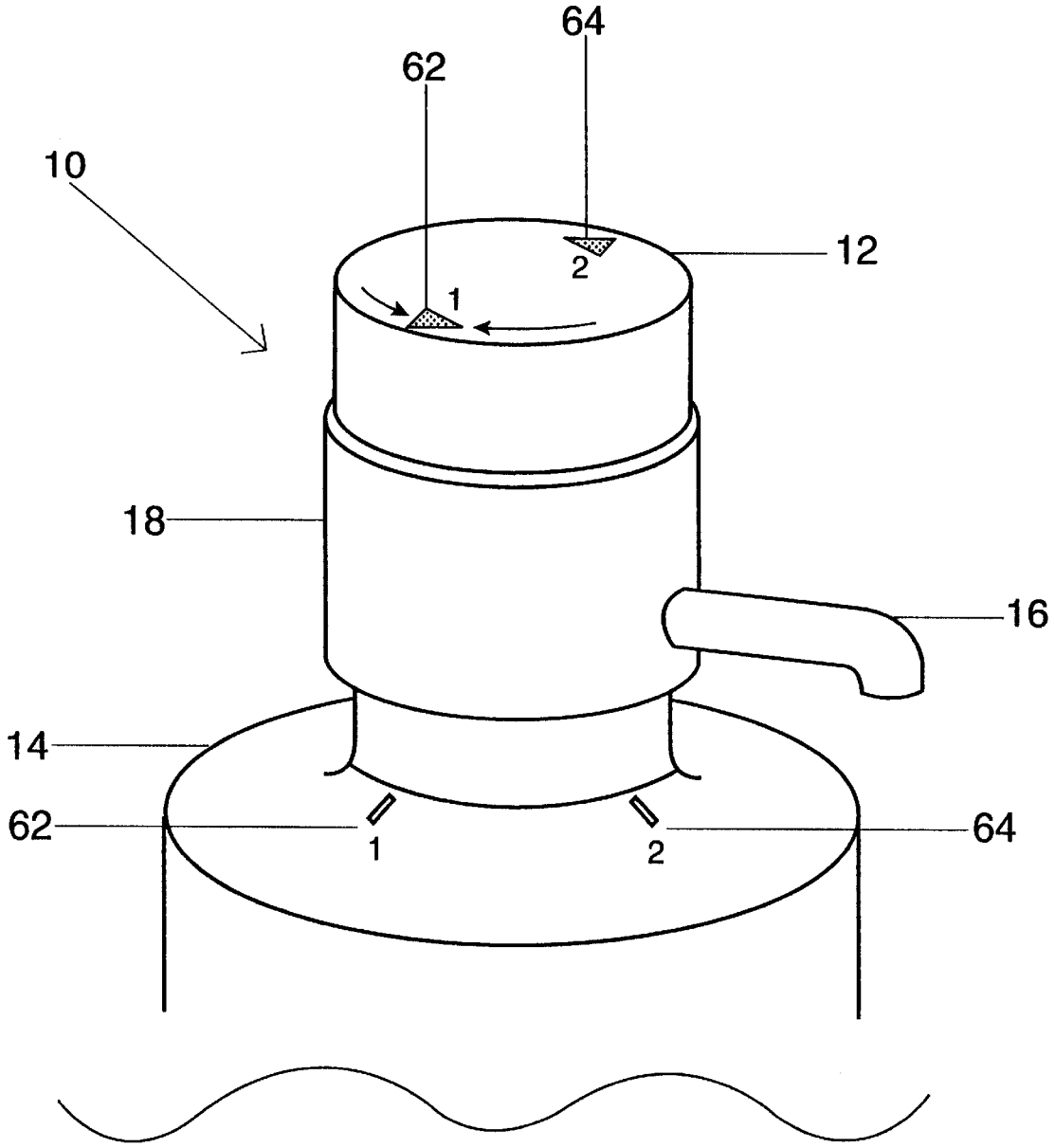
FIG. 1 is a perspective view of a dispensing pump incorporating the present child-resistant lock.

With reference to FIG. 1, a pump dispenser 10 including the present locking assembly is disclosed. As with conventional pump dispensers, the present invention is provided with an actuator 12 which is pushed downwardly to cause the flow of materials from a container 14. The pumped material exits through an outlet nozzle 16 mounted on an exterior support ring 18. The actuator 12 moves a pump mechanism (not shown) which draws material from within the container 14 and causes the material to flow out of the outlet nozzle 16. A variety of pump mechanisms are well known and the actual pump mechanism may vary. However, it should be understood that the up and down movement of the actuator 12 creates pressure causing the contents of the container to flow through, and out of, the pump dispenser 10. Examples of pump mechanisms are found in U.S. Pat. Nos. 4,867,347 to Wass et al. and 4,991,746 to Schultz, which are incorporated herein by reference.

Figure 2:
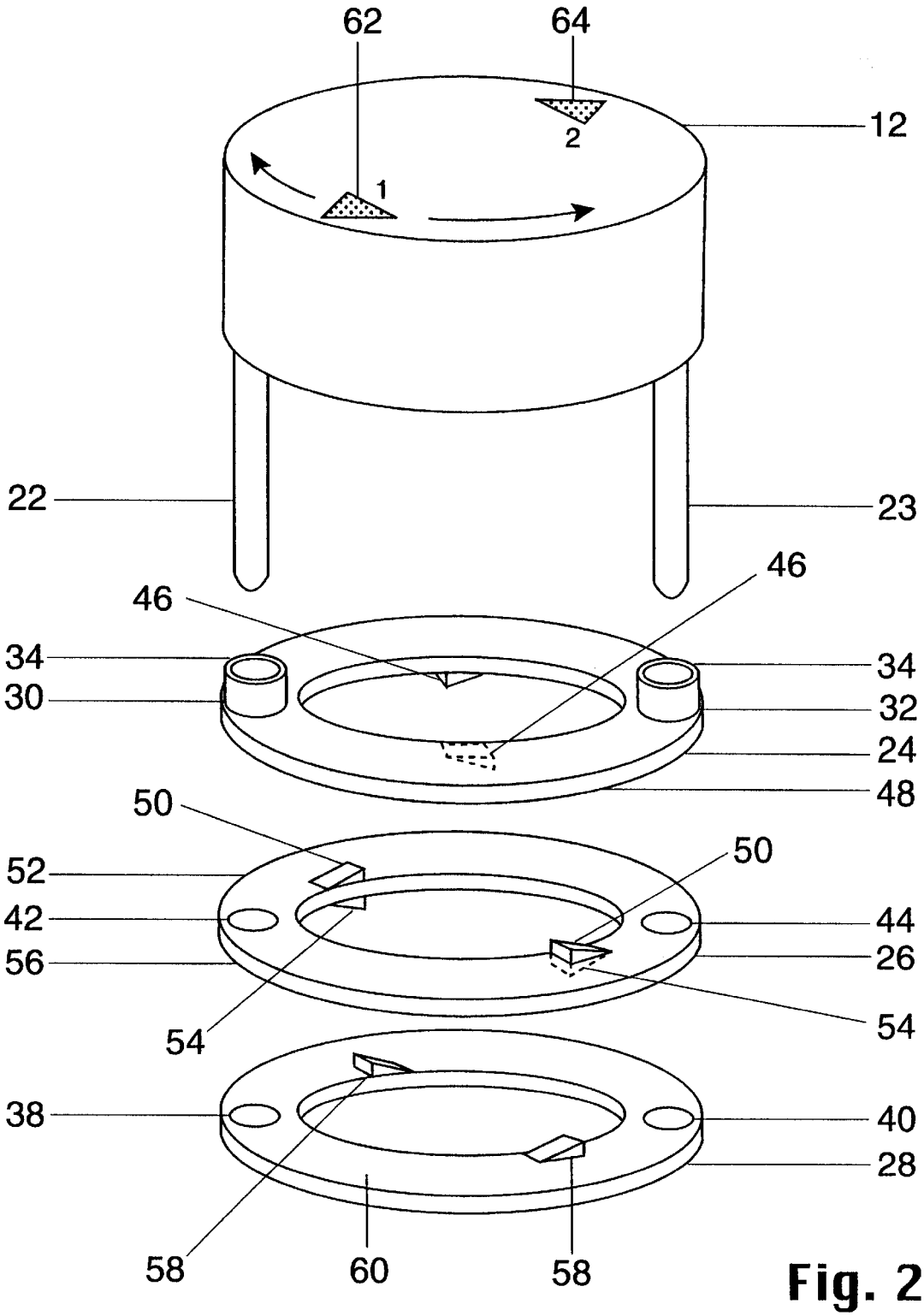
FIG. 2 is a perspective view with the exterior structure of the dispensing pump removed to show the structure of the present child-resistant lock.
Figure 3:
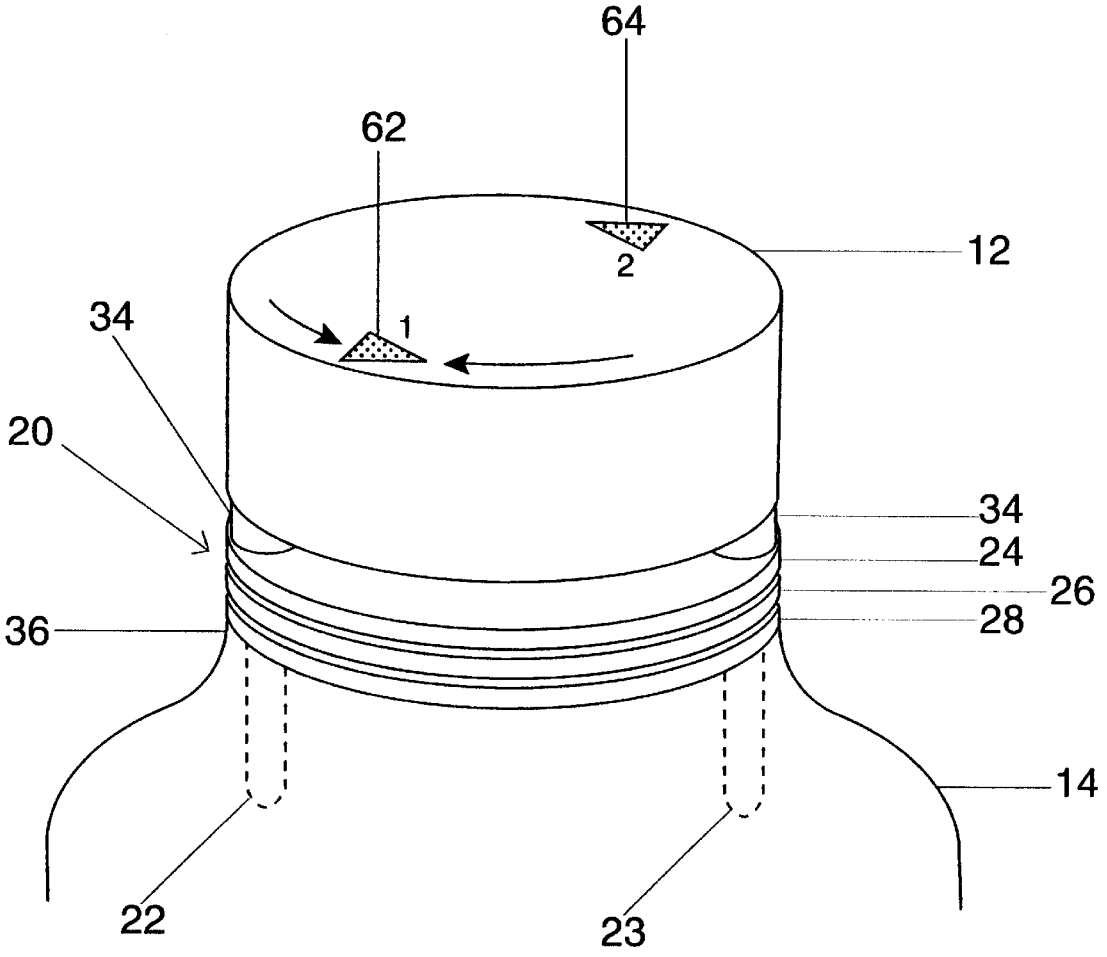
FIG. 3 is an exploded view of the child-resistant lock.

With this in mind, the present invention provides a lock assembly 20 which prevents children from moving the actuator up and down (that is, pumping) and causing the contents of the container to flow through the pump dispenser 10. With reference to FIGS. 2 and 3, the present locking assembly 20 includes an actuator 12 for drawing materials from a container 14 to dispense the materials from the container 14. The actuator 12 including a first downwardly extending timing pin 22 and a second downwardly extending timing pin 23. In accordance with the preferred embodiment of the present invention, the first and second timing pins 22, 23 are positioned on the actuator 12 at diametrically opposed positions, although the timing pins could be positioned on the actuator in a variety of locations without departing from the spirit of the invention. In addition, as will become readily apparent from the disclosure below, the actuator could be provided with one or more timing pins without departing from the spirit of the present invention.

The locking assembly 20 further includes an upper rotating ratchet disk 24, a central floating ratchet disk 26, and a lower fixed ratchet disk 28. The disks are interrelated for controlled movement by a locking ratchet structure. Each of the disks are substantially annular shaped, and create an open central space in which a pump mechanism (not shown) may be positioned for actuation by the actuator 12. The pump mechanism may consist of bellows or a piston assembly with a spring to return the actuator to the upward position, although a variety of pump assemblies could be utilized without departing from the spirit of the present invention.

Specifically, the upper rotating ratchet disk 24 includes a first hole 30 and a second hole 32. The first and second holes 30, 32 of the upper disk 24 are spaced in the same manner as the timing pins 22, 23 on the actuator 12. As a result, the first timing pin 22 passes through the first hole 30 while the second timing pin 23 is passing through the second hole 32. Each of the holes in the upper disk 24 are provided with an alignment sleeve 34. The alignment sleeves 34 extend upwardly from the surface of the upper disk 24 and create a cylindrical opening through which the timing pins 22, 23 pass.

As with the timing pins 22, 23 of the actuator 12, the preferred embodiment shows the first hole 30 and the second hole 32 diametrically opposed on the upper disk 24. However, the first hole and the second hole may be positioned on the upper disk in any manner that would permit the timing pins to simultaneously pass therethrough. In addition, one or more holes may be provided such that the central disk coordinates with the timing pins of the actuator.

The lower fixed disk 28 is preferably secured to a support surface 36 of the container 14. The lower fixed disk 28 includes a first hole 38 and a second hole 40. The first and second holes 38, 40 of the lower disk 28 are spaced in the same manner as the timing pins 22, 23 on the actuator 12 such that the first timing pin 22 passes through the first hole 38 while the second timing pin 23 is passing through the second hole 40. As with the timing pins 22, 23 of the actuator 12 and the holes 30, 32 in the upper disk 24 the preferred embodiment shows the first hole 38 and the second hole 40 diametrically opposed on the lower disk 28. However, the first hole and the second hole may be positioned on the lower disk in any manner that would permit the timing pins to simultaneously pass therethrough. In addition, one or more holes may be provided such that the lower disk coordinates with the timing pins of the actuator.

The central floating disk 26 is positioned between the upper disk 24 and the lower disk 28. The central disk 26 includes a first hole 42 and a second hole 44. The first and second holes 42, 44 of the central disk 26 are spaced in the same manner as the timing pins 22, 23 on the actuator 12. As a result, the first timing pin 22 passes through the first hole 42 while the second timing pin 23 is passing through the second hole 44. As with the timing pins 22, 23 of the actuator 12 and the holes 30, 32 in the upper disk 24, the preferred embodiment shows the first hole 42 and the second hole 44 diametrically opposed on the central disk 26. However, the first hole and the second hole may be positioned on the central disk in any manner that would permit the timing pins to simultaneously pass therethrough. In addition, one or more holes may be provided such that the central disk coordinates with the timing pins of the actuator.

As discussed above, a locking ratchet structure controls the movement of the upper disk 24, central disk 26, and lower disk 28 relative to each other. As will be discussed in greater detail below, the locking ratchet structure controls the movement of the disks to selectively align the holes in a manner permitting the timing pins to pass therethrough and allow the actuator to move up and down causing the contents of the container to move through the pump dispenser. Generally, the locking ratchet structure permits alignment of the disks by permitting the actuator 12 to rotate in a first direction to align the first and second holes 42, 44 in the central disk 26 with the respective first and second holes 38, 40 in the lower disk 28 and to rotate in a second direction, opposite the first direction, to align the first end second holes 30, 32 in the upper disk 24 with the respective first and second holes 42, 44 in the central disk 26.

Specifically, the locking ratchet structure includes two ratchet teeth 46 on a lower surface 48 of the upper disk 24. The two ratchet teeth 46 on the upper disk 24 are positioned to respectively engage two ratchet teeth 50 on an upper surface 52 of the central disk 26 such that the two ratchet teeth 46 on the upper disk 24 respectively engage the two ratchet teeth 50 on the central disk 26 to cause the upper disk 24 and the central disk 26 to rotate together when the actuator 12 is rotated in the first direction, for example, counter clockwise.

The locking structure further includes two ratchet teeth 54 on the lower surface 56 of the central disk 26. The two ratchet teeth 54 on the lower surface 56 of the central disk 26 are positioned to engage two ratchet teeth 58 on an upper surface 60 of the lower disk 28 such that the central disk 26 may rotate in the first direction relative to the lower fixed disk 28, but is prevented from rotating in a second direction, opposite the first direction, when the holes 42, 44 in the central disk 26 are aligned with the holes 38, 40 in the lower disk 28.

It should be understood that while the preferred embodiment of the locking structure includes the provision of two ratchet teeth on each of the effected disk surfaces, a variety of different ratchet structures could be utilized without departing from the spirit of the present invention.

In use, when the first and second holes 30, 32 in the upper disk 24, the first and second holes 42, 44 in the central disk 26, and the first and second holes 38, 40 in the lower disk 28 are not aligned, the two timing pins 22, 23 are prevented from passing through the holes and the actuator 12 is prevented from functioning to dispense material from the container 14. When, however, the first and second holes 30, 32 in the upper disk 24, the first and second holes 42, 44 in the central disk 26, and the first and second holes 38, 40 in the lower disk 28 are aligned, the two timing pins 22, 23 will pass through the holes, permitting the actuator 12 to function in dispensing material from the container 14.

Figure 4:
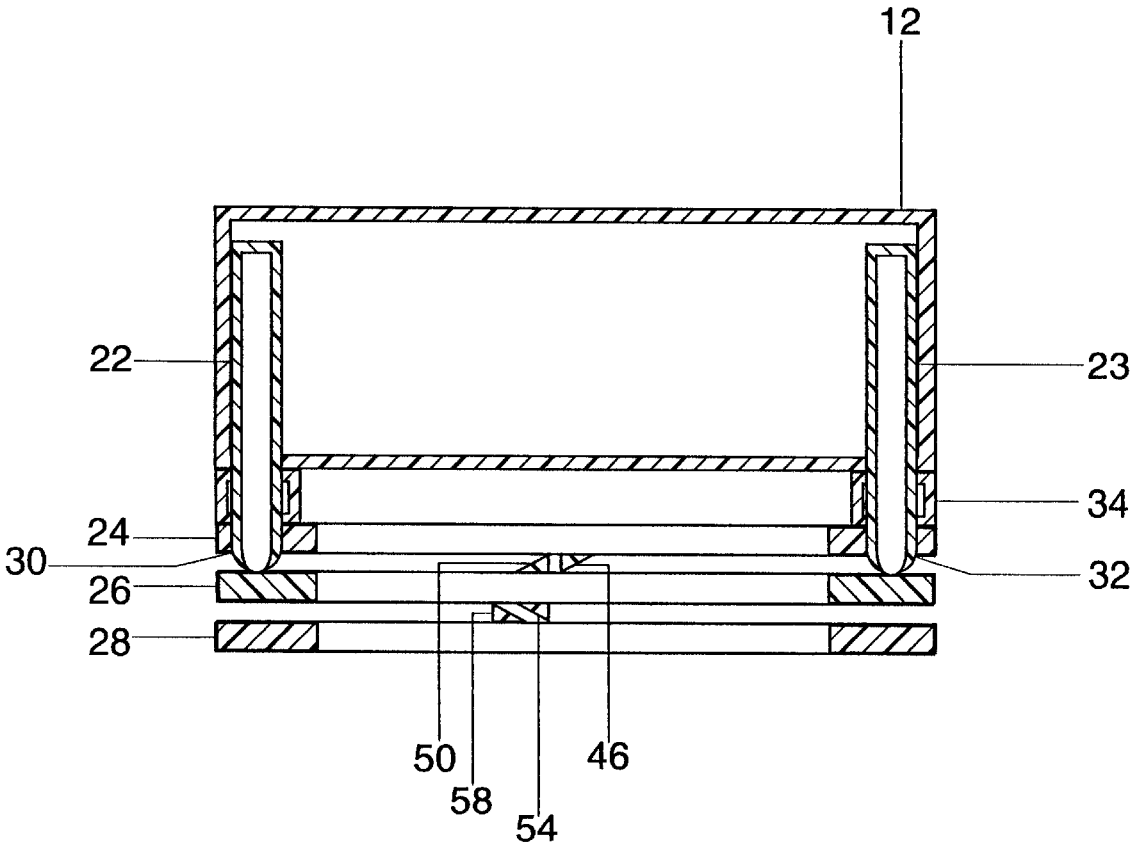
FIG. 4 is a cross-sectional view of the child-resistant lock showing the lock assembly in its first stage of operation.

The holes in the upper disk 24, central disk 26, and lower disk 28 are aligned in the following manner. With reference to FIG. 4, the actuator 12 is assembled with the first and second timing pins 22, 23 respectively inside first and second holes 30, 32 in the upper disk 24. Alignment of the timing pins 22, 23 within the first and second holes 30, 32 is enhanced by the provision of the first and second alignment sleeves 34. The alignment sleeves 34 hold the timing pins 22, 23 in alignment with the first and second holes 30, 32. In fact, it should be understood that the timing pins 22, 23 are always held within the alignment sleeves 34. As a result, the upper disk 24 always rotates with the actuator 12. In this way, a user need not position the timing pins 22, 23 relative to the first and second holes 30, 32 of the upper disk 24 each time he or she wishes to open the actuator 12 for use.

Figure 5:
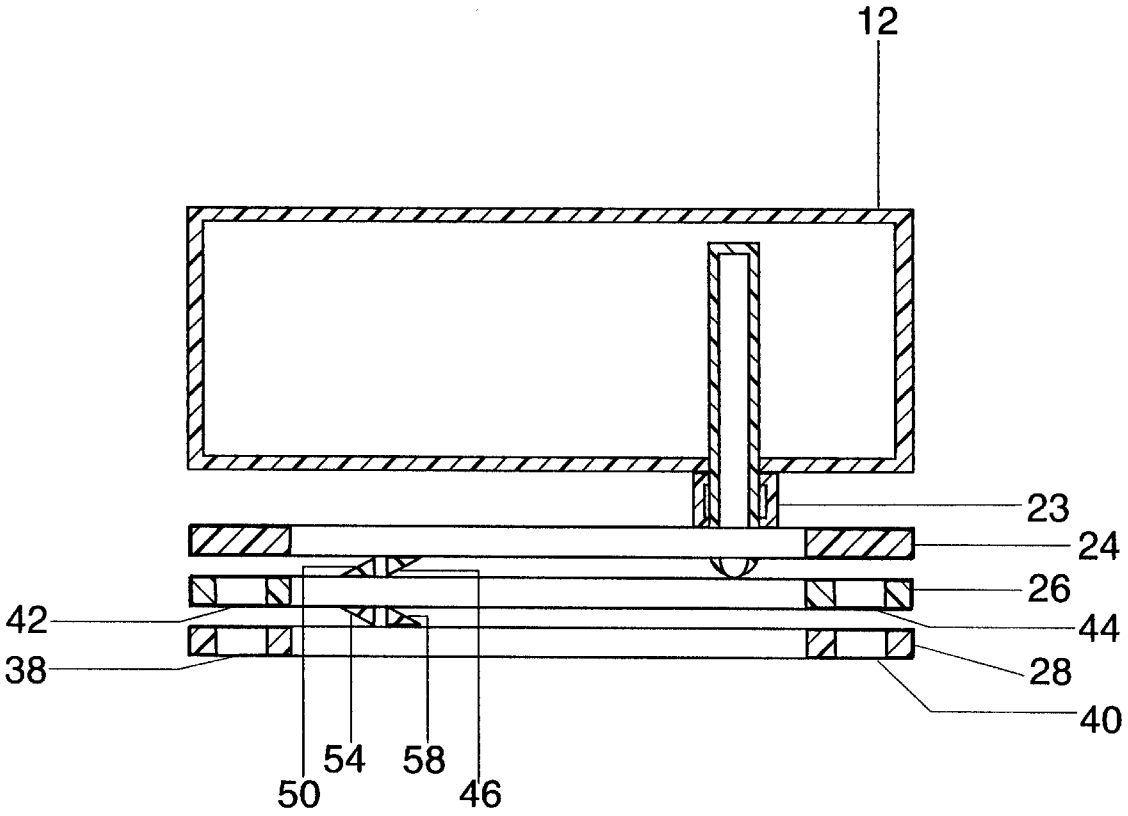
FIG. 5 is a cross-sectional view of the child-resistant lock showing the locking assembly in its second stage of operation.

The actuator 12 is first rotated in a counter clockwise direction. This causes the upper disk 24 to rotate. As the upper disk 24 rotates, the two ratchet teeth 46 of the upper disk 24 engage the two ratchet teeth 50 on the upper surface 52 of the central disk 26. The central disk 26 is then rotated with the upper disk 24 in a counter clockwise direction until the ratchet teeth 54 on the lower surface 56 of the central disk 26 engage, and snap past, the ratchet teeth 58 on the upper surface 60 of the lower disk 28. At this point the holes 42, 44 in the central disk 26 and the holes 38, 40 in the lower disk 28 are aligned (see FIG. 5). In addition, the shape of the ratchet teeth 54 of the lower surface 56 of the central disk 26 and the ratchet teeth 58 of the lower disk 28 prevent the central disk 26 from rotating clockwise relative to the lower disk 28.

Figure 6:
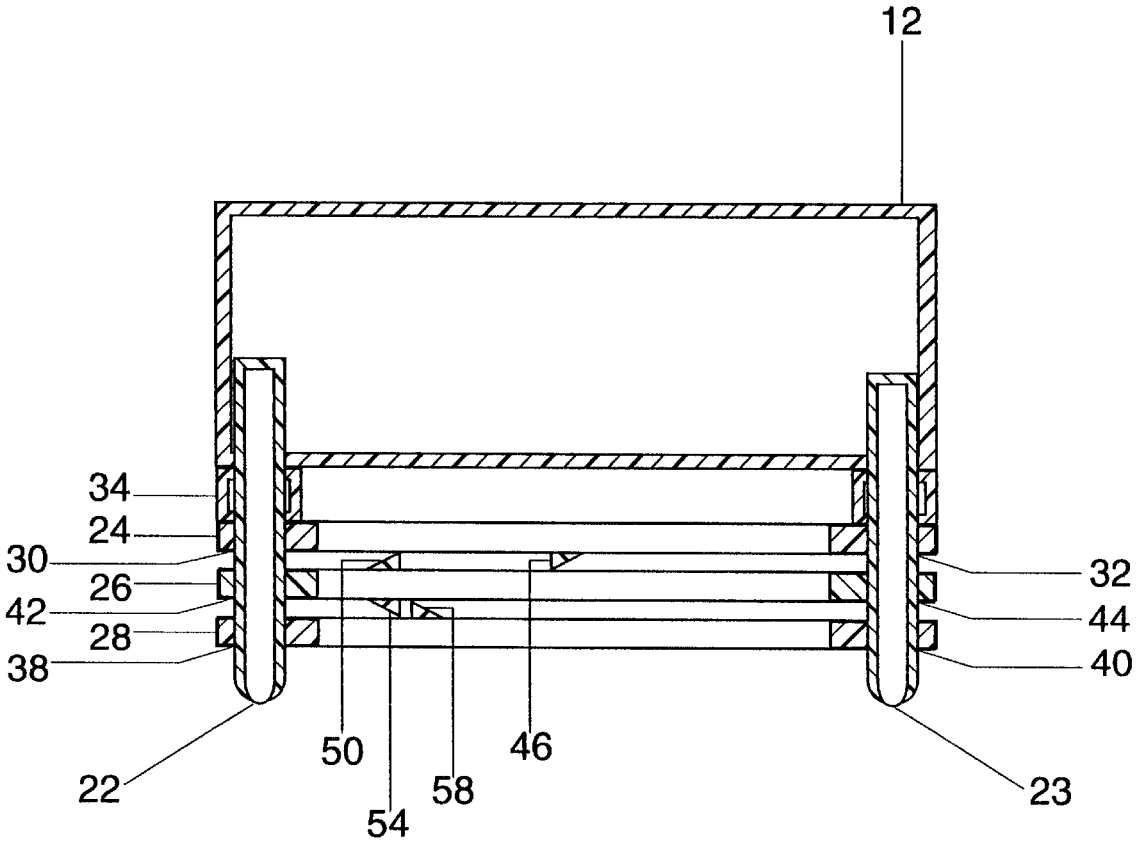
FIG. 6 is a cross-sectional view of the child-resistant lock showing the locking assembly in its third stage of operation.

The actuator 12 is then rotated clockwise until the holes 30, 32 in the upper disk 24 are aligned with the holes 42, 44 in the central disk 26 and the holes 38, 40 in the lower disk 28. Once these holes are aligned, the first and second timing pins 22, 23 may pass vertically through the upper disk 24, central disk 26 and lower disk 28, allowing the pump dispenser 10 to be actuated (see FIG. 6).

Alignment of the holes in the upper disk 24, the central disk 26, and the lower disk 28 is simplified by the provision of first and second indicators 62, 64. Specifically, the actuator is provided with a first indicator 62, comprising a pair of alignable marks (as shown in FIG. 1) indicating when the first and second holes 42, 44 in the central disk 26 and the first and second holes 38, 40 in the lower disk 28 are aligned. The actuator is also provided with a second indicator 64 comprising a pair of alignable marks (as shown in FIG. 1), indicating when the first and second holes 30, 32 in the upper disk 24 are aligned with the first and second holes 42, 44 in the central disk 26 and the first and second holes 38, 40 in the lower disk 28.

In alternate embodiments of the present invention, it would be possible to construct the locking ratchet structure such that each disk is provided with full series of ratchets about the circumference of the disk. However, if the disks were provided with a full series of ratchet teeth about their circumference, the snaps caused as the ratchet teeth move past each other would not be indicative of the alignment of the holes and it would be necessary to use indicators, constructed specific to this embodiment, as the sole means for determining when the holes in the disks are properly aligned. Specifically, interaction between the ratchet teeth of the upper disk and the central disk would cause snaps before the holes are aligned. As a result, the user would simply rotate the actuator counter clockwise until the first indicator indicated that the holes of the upper and central disks were properly aligned. Similarly, the actuator would be rotated clockwise until the second indicator indicated that the holes of the lower disk were properly aligned.

While the preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. A pump-type dispenser for dispensing material from a container, comprising:

an actuator including a timing pin, wherein the timing pin extends downwardly from the actuator;

and a locking mechanism coupled to the actuator for limiting movement of the actuator to dispense material from a container until the timing pin is properly aligned with the locking mechanism, wherein alignment is achieved by rotating the actuator a first predetermined distance in a first direction and subsequently rotating the actuator a second predetermined distance in a second direction, the locking mechanism including;

a first disk including at least one hole, wherein the timing pin passes through the at least one hole such that the first disk rotates with the actuator;

a second disk secured to a support surface of the container, the second disk including a hole through which the timing pin passes when the hole in the second disk is aligned with the hole in the first disk; and locking structure associated with the first disk and the second disk, permitting the actuator to rotate to align the hole in the first disk with the hole in the second disk;

wherein, when the hole in the first disk and the hole in the second disk are not aligned, the timing pin is prevented from passing through the hole in the first disk and the hole in the second disk, and the actuator is prevented from moving up and down to dispense material from the container, the locking mechanism further including;

a third disk positioned between the first disk and the second disk, the third disk including a hole through which the timing pin passes when the hole in the third disk is aligned with the hole in the first disk; and a locking structure associated with the first disk, the second disk, and the third disk, permitting the actuator to rotate in a first direction to align the hole in the second disk with the hole in the third disk and to rotate in a second direction, opposite the first direction, to align the hole in the first disk with the hole in the third disk;

wherein, when the hole in the first disk, the hole in the second disk, and the hole in the third disk are not aligned, the one timing pin is prevented from passing through the hole in the first disk, the hole in the second disk, and the hole in the third disk, and the actuator is prevented from moving up and down to dispense materials from the container.

2. The pump-type dispenser according to claim 1, wherein the locking structure includes a series of ratchet teeth secured to the first disk, the third disk, and the second disk.

3. The pump-type dispenser according to claim 2, wherein the locking structure includes a ratchet tooth on a lower surface of the first disk, the ratchet tooth on the first disk being positioned to engage a ratchet tooth on an upper surface of the third disk such that the ratchet tooth on the first disk engages the ratchet tooth on the third disk to cause the first disk and the third disk to rotate together when the actuator is rotated in the first direction;

the third disk including a ratchet tooth on a lower surface of the third disk, the ratchet tooth on the lower surface of the third disk being positioned to engage a ratchet tooth on an upper surface of the second disk such that the third disk is rotatable in the first direction relative to the second disk, but is prevented from rotating in a second direction, opposite the first direction, when the hole the third disk is aligned with the hole in the second floating disk.

4. The pump-type dispenser according to claim 1, wherein the actuator includes a first downwardly extending timing pin and a second downwardly extending timing pin, the first disk includes a first hole and a second hole, the third disk includes a first hole and a second hole, and the second disk includes a first hole and a second hole, the first holes and the second holes of the disks being positioned such that they are alignable to permit the first timing pin and the second timing pin to simultaneously pass through the respective first holes and second holes, thereby permitting the actuator to function to dispense material from the container.

5. A pump dispenser including a locking assembly, comprising:

an actuator for drawing materials from a container to dispense the materials from the container, the actuator including a downwardly extending timing pin;

an upper rotating disk including at least one hole, wherein the timing pin passes through the at least one hole such that the upper rotating disk rotates with the actuator;

a lower fixed disk secured to a support surface of the container, the lower fixed disk including at least one hole through which the timing pin passes when the hole in the lower fixed disk is aligned with the hole in the upper rotating disk;

a central floating disk positioned between the upper rotating disk and the lower fixed disk, the central floating disk including at least one hole through which the timing pin passes when the hole in the central floating disk is aligned with the hole in the upper rotating disk; and locking structure associated with the upper rotating disk, the central floating disk, and the lower fixed disk, permitting the actuator to rotate in a first direction to align the hole in the central floating disk with hole in the lower fixed disk and to rotate in a second direction, opposite the first direction, to align the hole in the upper rotating disk with the hole in the central fixed disk;

wherein, when the hole in the upper rotating disk, the hole in the central floating disk, and the hole in the lower fixed disk are not aligned, the timing pin is prevented from passing through the holes in the upper rotating disk, the central floating disk, and the lower fixed disk, and the actuator is prevented from moving up and down to dispense materials from the container.

6. The dispenser according to claim 5, wherein the locking structure includes a series of ratchet teeth secured to the upper rotating disk, the central floating disk, and the lower fixed disk.

7. The dispenser according to claim 6, wherein the locking structure includes a ratchet tooth on a lower surface of the upper rotating disk, the ratchet tooth on the upper rotating disk being positioned to engage a ratchet tooth on an upper surface of the central floating disk such that the ratchet tooth on the upper rotating disk engages the ratchet tooth on the central floating disk to cause the upper rotating disk and the central floating disk to rotate together when the actuator is rotated in the first direction;

the central floating disk including a ratchet tooth on a lower surface of the central floating disk, the ratchet tooth on the lower surface of the central floating disk being positioned to engage a ratchet tooth on an upper surface of the lower fixed disk such that the central floating disk is rotatable in the first direction relative to the lower fixed disk, but is prevented from rotating in a second direction, opposite the first direction, when the hole the central floating disk is aligned with the hole in the lower fixed floating disk.

8. The dispenser according to claim 7, wherein the locking structure includes at least two ratchet teeth on a lower surface of the upper rotating disk, the at least two ratchet teeth on the upper rotating disk being positioned to respectively engage at least two ratchet teeth on an upper surface of the central floating disk such that the at least two ratchet teeth on the upper rotating disk respectively engage the at least two ratchet teeth on the central floating disk to cause the upper rotating disk and the central floating disk to rotate together when the actuator is rotated in the first direction;

the central floating disk including at least two ratchet teeth on a lower surface of the central floating disk, the at least two ratchet teeth on the lower surface of the central floating disk being positioned to engage at least two ratchet teeth on an upper surface of the lower fixed disk such that the central floating disk is rotatable in the first direction relative to the lower fixed disk, but is prevented from rotating in a second direction, opposite the first direction, when the hole the central floating disk is aligned with the hole in the lower fixed floating disk.

9. The dispenser according to claim 5, wherein the actuator includes at least one indicator for indicating when the holes in the upper rotating disk, the central floating disk and the lower fixed disk are aligned.

10. The dispenser according to claim 9, wherein the actuator includes a first indicator indicating when the hole in the upper rotating disk is aligned with the hole in the central floating disk and a second indicator indicating when the hole in the central floating disk is aligned with the hole in the lower fixed disk.

11. The dispenser according to claim 5, wherein the actuator includes a first downwardly extending timing pin and a second downwardly extending timing pin, the upper rotating disk includes a first hole and a second hole, the central floating disk includes a first hole and a second hole, and the lower fixed disk includes a first hole and a second hole, the first holes and the second holes of the disks being positioned such that they are alignable to permit the first timing pin and the second timing pin to simultaneously pass through the respective first holes and second holes, thereby permitting the actuator to function to dispense material from the container.

12. A container, comprising:

a body for storing materials therein, the body having a pump dispenser secured thereto;

the pump dispenser includes;

an actuator including a timing pin, wherein the timing pin extends downwardly from the actuator;

and a locking mechanism coupled to actuator for limiting movement of the actuator to dispense material from the container until the timing pin is properly aligned with the locking mechanism, wherein alignment is achieved by rotating the actuator a first predetermined distance in a first direction and subsequently rotating the actuator a second predetermined distance in a second direction, opposite the first direction, the locking mechanism including;

a first disk including at least one hole, wherein the timing pin passes through the at least one hole such that the first disk rotates with the actuator;

a second disk secured to a support surface of the container, the second disk including a hole through which the timing pin passes when the hole in the second disk is aligned with the hole in the first disk; and locking structure associated with the first disk and the second disk, permitting the actuator to rotate to align the hole in the first disk with the hole in the second disk;

wherein, when the hole in the first disk and the hole in the second disk are not aligned, the one timing pin is prevented from passing through the hole in the first disk and the hole in the second disk, and the actuator is prevented from moving up and down to dispense material from the container, the locking mechanism further including;

a third disk positioned between the first disk and the second disk, the third disk including a hole through which the timing pin passes when the hole in the third disk is aligned with the hole in the first disk; and a locking structure associated with the first disk, the second disk, and the third disk, permitting the actuator to rotate in a first direction to align the hole in the second disk with the hole in the third disk and to rotate in a second direction, opposite the first direction, to align the hole in the first disk with the hole in the third disk;

wherein, when the hole in the first disk, the hole in the second disk, and the hole in the third disk are not aligned, the one timing pin is prevented from passing through the hole in the first disk, the hole in the second disk, and the hole in the third disk, and the actuator is prevented from moving up and down to dispense material from the container.

13. The container according to claim 12, wherein the locking structure includes a series of ratchet teeth secured to the first disk, the third disk, and the second disk.

14. The container according to claim 13, wherein the locking structure includes a ratchet tooth on a lower surface of the first disk, the ratchet tooth on the first disk being positioned to engage a ratchet tooth on an upper surface of the third disk such that the ratchet tooth on the first disk engages the ratchet tooth on the third disk to cause the first disk and the third disk to rotate together when the actuator is rotated in the first direction;

the third disk including a ratchet tooth on a lower surface of the third disk, the ratchet tooth on the lower surface of the third disk being positioned to engage a ratchet tooth on an upper surface of the second disk such that the third disk is rotatable in the first direction relative to the second disk, but is prevented from rotating in a second direction, opposite the first direction, when the hole the third disk is aligned with the hole in the second floating disk.

15. The container according to claim 12, wherein the actuator includes a first downwardly extending timing pin and a second downwardly extending timing pin, the first disk includes a first hole and a second hole, the third disk includes a first hole and a second hole, and the second disk includes a first hole and a second hole, the first holes and the second holes of the disks being positioned such that they are alignable to permit the first timing pin and the second timing pin to simultaneously pass through the respective first holes and second holes, thereby permitting the actuator to function to dispense material from the container.

* * * * *